US005343231A

United States Patent [19]

Suzuki

[11] Patent Number: 5,343,231

[45] Date of Patent: Aug. 30, 1994

[54] IMAGE RECORDING APPARATUS CAPABLE OF CORRECTING DENSITY UNEVENNESS

[75] Inventor: Akio Suzuki, Yokohama, Japan

[73] Assignee: Canon Kabushiki Kaisha, Tokyo, Japan

[21] Appl. No.: 3,992

[22] Filed: Jan. 15, 1993

Related U.S. Application Data

[63] Continuation of Ser. No. 751,952, Aug. 29, 1991, abandoned.

[30] Foreign Application Priority Data

Aug. 31, 1990 [JP] Japan ..... 2-228396

[51] Int. Cl.[5] ..... B41J 2/05

[52] U.S. Cl. ..... 347/14; 347/15

[58] Field of Search ..... 346/140; 358/296

[56] References Cited

U.S. PATENT DOCUMENTS

| | | | |
|---|---|---|---|
| 4,313,124 | 1/1982 | Hara . | |
| 4,345,262 | 8/1982 | Shirato et al. . | |
| 4,459,600 | 7/1984 | Sato et al. . | |
| 4,463,359 | 7/1984 | Ayata et al. . | |
| 4,558,333 | 12/1985 | Sugitani et al. . | |
| 4,723,129 | 2/1988 | Endo et al. . | |
| 4,740,796 | 4/1988 | Endo et al. . | |
| 4,827,279 | 5/1989 | Lubinsky et al. | 346/1.1 |
| 4,829,323 | 5/1989 | Suzuki | 346/140 R |
| 4,977,459 | 12/1990 | Ebinuma et al. | 346/140 R X |
| 5,023,626 | 6/1991 | Kawamura | 346/140 R X |
| 5,036,337 | 7/1991 | Rezanka | 346/140 R X |
| 5,038,208 | 8/1991 | Ichikawa | 358/80 X |

FOREIGN PATENT DOCUMENTS

| | | |
|---|---|---|
| 54-56847 | 5/1979 | Japan . |
| 59-123670 | 7/1984 | Japan . |
| 59-138461 | 8/1984 | Japan . |
| 60-71260 | 4/1985 | Japan . |

*Primary Examiner*—Joseph W. Hartary

*Attorney, Agent, or Firm*—Fitzpatrick, Cella, Harper & Scinto

[57] ABSTRACT

An image forming apparatus is provided by which a certain test pattern is recorded with a recording head having a plurality of recording elements, and the degree of density unevenness of each recording element of the recording head is calculated by reading the test pattern. The temperature of the recording head is detected and the degree of density unevenness calculated is corrected according to the detected temperature, thereby calculating correction data with respect to each recording element. At the time of image recording, image data input for each recording element is changed based on the correction data to correct any unevenness in density of the recorded image.

22 Claims, 7 Drawing Sheets

IMAGE RECORDING APPARATUS CAPABLE OF CORRECTING DENSITY UNEVENNESS

This application is a continuation of application Ser. No. 07/751,952 filed Aug. 29, 1991, abandoned.

BACKGROUND OF THE INVENTION

1. Field Of the Invention

This invention relates to an image recording apparatus and, more particularly, to an image recording apparatus that includes a multi-element head having a plurality of recording elements.

2. Description of the Prior Art

With the popularization of computers and communication apparatuses, the application of recording apparatuses for effecting digital image recording with an ink jet type or thermal transfer type recording head has rapidly been promoted. As recording heads for image forming apparatuses, multi-element heads having a plurality of image recording elements integrally combined are generally used for the purpose of increasing recording speed. For example, ink jet recording heads are generally constructed as multi-nozzle heads having a plurality of nozzles integrally combined. Also, thermal transfer type heads are usually constructed by combining a plurality of heaters.

However, it is difficult to uniformly manufacture a multi-element head having a plurality of image recording elements, and the characteristics of the image recording elements vary to some extent. For example, in an ink jet multi-element head, there are variations in the shape of the nozzles. In a thermal transfer multi-element head, there are variations in the shape and the resistance of the heaters. Non-uniformity of the characteristics of image recording elements appears as non-uniformity of the size or the density of dots recorded by the image recording elements, so that the recorded image is uneven in density.

To cope with this problem, various methods for obtaining a uniform image have been proposed which are based on changing signals supplied to the image recording elements so as to correct such unevenness. For example, in the case of a multi-element head having recording elements 2 arranged as shown in FIG. 5(*a*), density unevenness may occur as shown in FIG. 5(*c*) when the input signal level is constant as shown in FIG. 5(*b*) . In this case, the input signal level is changed for compensation as shown in FIG. 5(*d*); the input signal is supplied at a higher level to the recording elements corresponding to a low-density portion while the input signal is supplied at a lower level to the recording elements corresponding to a high-density portion. In the case of a recording system capable of changing the diameter or density of dots, the diameter of dots recorded by each recording element is changed in accordance with the input signal level. For example, the drive voltage or the width of pulses applied to each piezoelectric element in the case of piezoelectric ink jet printing or to each heater in the case of thermal transfer printing is changed in accordance with the input signal so that the dot diameters or the dot densities determined by the recording elements are generally equal, and so that the distribution of density of the recorded image is made uniform as shown in FIG. 5(*e*). In a case where it is impossible or difficult to change the dot diameter or dot density, the number of dots is changed according to the input signal in such a manner that a greater number of dots are formed by the image recording elements corresponding to a low-density portion while a smaller number of dots are formed by the recording elements corresponding to a high-density portion, thereby making the density distribution uniform, as shown in FIG. 5(*e*).

The following is an example of a method of determining the amount of this compensation.

A case of density unevenness correction for a multi-element head having 256 nozzles will be described below.

It is assumed here that the distribution of density unevenness in the case of recording using a uniform image signal S is as shown in FIG. 6. First, the mean density $\overline{OD}$ of an image formed by this head is obtained. Next, the density $OD_1$ to $OD_{256}$ of portions corresponding to the nozzles are measured. The deviation for each nozzle, $\Delta OD_n$, is obtained using the formula: $\Delta OD_n = \overline{OD} - OD_n$ (n=1 to 256). If the relationship between the level of the image signal and the output density is as shown in FIG. 7, the image signal may be changed by $\Delta S$ to correct the density by $\Delta OD_n$. For this correction, the image signal may be changed by table conversion as shown in FIG. 8. In FIG. 8, the line A is a straight line having a slope or inclination of 1.0. With respect to the straight line A, the input signal is output without being changed. With respect to the line B, which is a straight line having a slope smaller than that of the line A, an output $S-\Delta S$ is obtained from an input Accordingly, the image signal supplied to the nth nozzle may be changed by table conversion as indicated by the line B in FIG. 8 before driving the head, whereby the density of the portion printed by this nozzle is made equal to $\overline{OD}$. If this processing is performed with respect to all the nozzles, the density unevenness is corrected and an uniform image can be obtained. That is, data for suitable conversion tables for compensation of image signals with respect to the nozzles is prepared to enable correction of such unevenness.

Although density unevenness can be suitably corrected by this method for at least the initial usage of the device, it is necessary to change the amount of compensation of the input signal for correcting the unevenness, if the degree of density unevenness is changed after time. In the case of an ink jet head, the density distribution is usually changed by deposits of ink or extraneous material to a nozzle portion in the vicinity of the ink outlet. In the case of a thermal transfer head, as well, there is a possibility of a change in the density distribution due to deterioration or change in the characteristics of each heater. In such cases, the amount of input correction initially set for density unevenness correction becomes insufficient, and the density unevenness becomes more conspicuous with time.

A method has been proposed of providing a density unevenness reader section in an image recording apparatus and revising density unevenness correction data by periodically reading the density unevenness distribution with the reader. In this method, the correction data is revised according to the change in the density unevenness distribution of the head to constantly maintain the desired uniformity of the recorded image free from density unevenness.

Correction data is prepared with respect to each recording apparatus actually used, and it is therefore necessary to set the period of time for preparing correction data to a very short time to limit the down time of the apparatus.

However, the effect of correction is unsatisfactory if reading of density unevenness and formation of correction data are performed only one time, and, in most cases, the uniformity of the recording image cannot be improved as desired unless these operations are repeated several times or ten and several times. The cause of this fact is a change in a variation in a gradation characteristic due to a change in the temperature of the head, which is caused as described below. In a case where the head has a gradation characteristic such as that indicated by the line C in FIG. 9, a degree ΔOD of density unevenness can be corrected by changing the image signal S by ΔS, as described above. However, the gradation characteristic of the recording head depends upon the temperature of the head. For example, in the case of ink jet recording, if the temperature of the head is increased, the viscosity of the ink is reduced, so that the amount of ink is increased while the ejection energy is constant, resulting in an increase in dot diameter. That is, a gradation characteristic such as that indicated by the line D in FIG. 9 is exhibited. When the head has this gradation characteristic, and when correction of ΔS is effected based on detecting density unevenness ΔOD, the amount of density unevenness correction is only ΔOD', and a uniform image cannot be obtained by performing the correction operation only one time.

Thus, the necessary amount of correction is changed as the gradation characteristic of the head varies. The density unevenness cannot be sufficiently corrected by effecting reading and correction one or two times, and it is necessary to repeat the same operation many times.

SUMMARY OF THE INVENTION

In view of the above-described problems, an object of the present invention is to provide an image recording apparatus capable of correcting density unevenness with accuracy.

It is another object of the present invention to provide an image recording apparatus capable of preparing density unevenness correction data in a short time even if the temperature of the recording head fluctuates.

It is still another object of the present invention to provide an image recording apparatus which records a predetermined pattern, thereafter reads this pattern, calculates the degree of density unevenness based on data on the read pattern, and corrects the degree of density unevenness based on a temperature relating to the recording head to obtain recording head correction data.

It is yet another object of the present invention to provide an image recording apparatus having a recording device, a temperature detector, a density unevenness calculator, a correction data calculator, and an image signal corrector. The recording device includes a plurality of image recording elements for receiving image signals. The temperature detector detects a temperature of the recording device and outputs a detection result. The density unevenness calculator calculates a degree of density unevenness of the recording device from a value obtained by reading recording densities on a test pattern formed by the image recording elements of the recording device. The correction data calculator calculates density unevenness correction data by correcting the degree of density unevenness based on the detection result output by the temperature detector. The image signal corrector corrects image signals to be input to the recording elements of the recording device based on the density unevenness correction data calculated by the correction data calculator.

These and other objects of the invention will become apparent from the following description of preferred embodiments of the invention taken in conjunction with the accompanying drawings.

DESCRIPTION OF THE PREFERRED EMBODIMENTS

Embodiments of the present invention will be described below with reference to the accompanying drawings.

Figure 1:
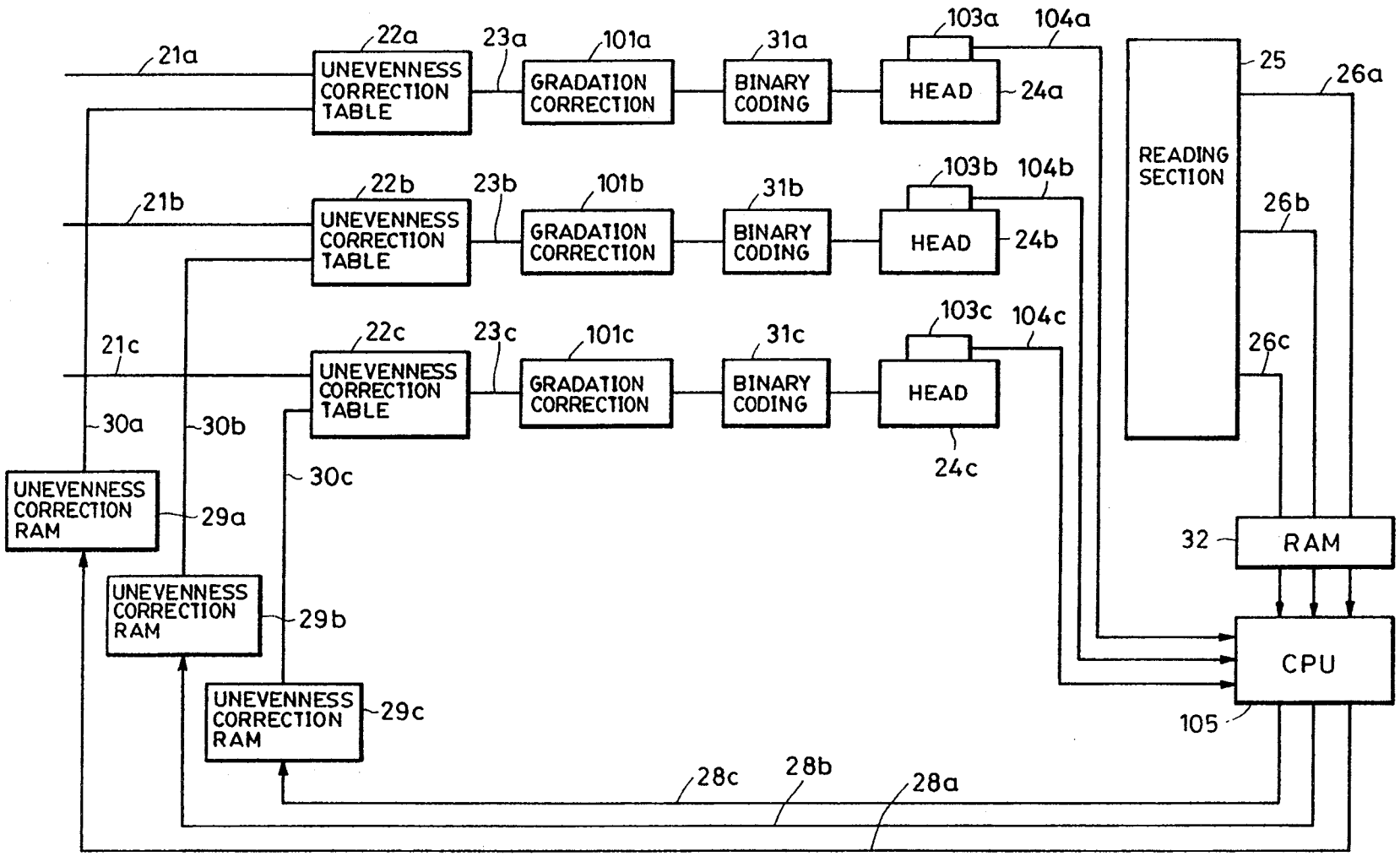
FIG. 1 is a block diagram of an image recording apparatus in accordance with a first embodiment of the present invention.

FIG. 1 is a block diagram of the first embodiment of the present invention. Image signals 21*a*, 21*b*, and 21*c* for three colors: cyan, magenta and yellow are respectively supplied to density unevenness correction tables 22*a*, 22*b*, and 22*c* for correction of these colors. Unevenness correction image signals 23*a*, 23*b*, and 23*c* relating to the three colors are output from the tables 22*a*, 22*b*, and 22*c* and are respectively input into gradation correction tables 101*a*, 101*b*, and 101*c*. Signals output from the tables 101*a* to 101*c* are input into binary coding circuits 31*a*, 31*b*, and 31*c* which convert input data into binary digits by a dither method, an error diffusion method or the like. Signals output from the binary coding circuits 31*a* to 31*c* are input into ink jet heads 24*a*, 24*b*, and 24*c* each having 256 nozzles for jetting ink of one of the three colors. In this embodiment, each nozzle is provided with an electro-thermo-conversion element which is selectively energized to change the state of the ink, i.e., create bubbles in the ink, so that the ink is jetted through the outlet orifice. A reading section 25 is provided with a photo-electric conversion element (CCD) which has filters of three colors, red (R), green (G) and blue (B) and with which an image is read by photo-electric conversion to output red, green and blue signals 26*a*, 26*b*, and 26*c*, respectively. The signals 26*a*, 26*b*, and 26*c* output from the reading section 25 are temporarily stored in a RAM 32. A CPU 105 calculates correction data based on the signals R, G, and B supplied from the RAM 32 and supplies groups of cyan, magenta and yellow unevenness correction data 28*a*, 28*b*, and 28*c* to unevenness correction RAMs 29a, 29b, and 29c, respectively. Unevenness correction signals 30*a*, 30*b*, and 30*c* are output from the unevenness correction RAMs 29a to 29c to be input into the unevenness correction tables 22*a* to 22*c*. Sensors 103*a*, 103*b*, and 103*c* are attached to the heads 24a to 24c to output temperature signals 104a, 104b, and 104c.

Figure 2:
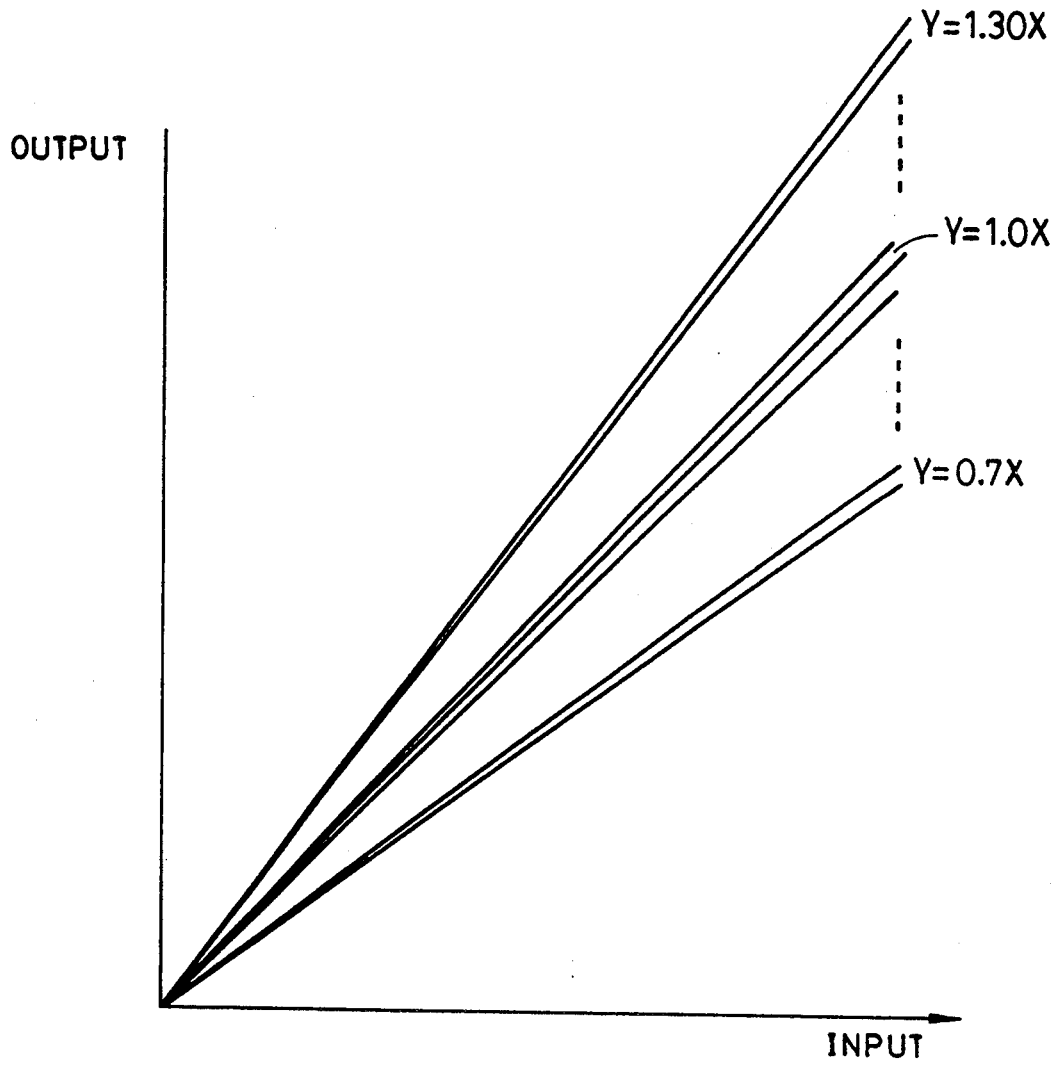
FIG. 2 is a diagram of density unevenness correction lines used in the present invention.

The image signals 21a to 21c are converted by the unevenness correction tables 22a to 22c controlled by the unevenness correction signals 30a to 30c so as to correct degrees of unevenness of the heads 24a to 24c. Each unevenness correction table has 61 straight correction lines ($\gamma$) having slopes differing in pitch by increments of 0.01 and ranging from from $Y=0.70\,X$ to $Y=1.30\,X$, as shown in FIG. 2. The straight correction lines are changed according to the unevenness correction signals 30a to 30c. For example, if a signal for a pixel printed by one of the nozzles having a larger dot diameter is supplied, one of the straight correction lines having a smaller slope is selected, or, with respect to one of the nozzles having a smaller dot diameter, one of the straight correction lines having a greater slope is selected, thus changing the image signal for unevenness correction.

In each unevenness correction RAM, straight correction line selection signals necessary for correction of the degree of unevenness of the corresponding head are stored. That is, correction signals having 61 values, i.e., 0 to 60 and provided for the 256 nozzles are stored in each unevenness correction RAM. The unevenness correction signals 30a to 30c are output in synchronization with the input image signals. The signals 23a to 23c changed for unevenness correction based on straight lines $\gamma$ selected by the unevenness correction signals 30a to 30c are input into the gradation correction tables 101a to 101c and are output after being changed therein to correct the gradation characteristics of the heads.

The signals are thereafter converted into binary signals by the binary coding circuits 31a, 31b, and 31c and are used to drive the heads 24a, 24b, and 24c to form a color image.

A method of preparing density unevenness correction data in accordance with this embodiment will be described below with reference to FIG. 3.

Figure 3:
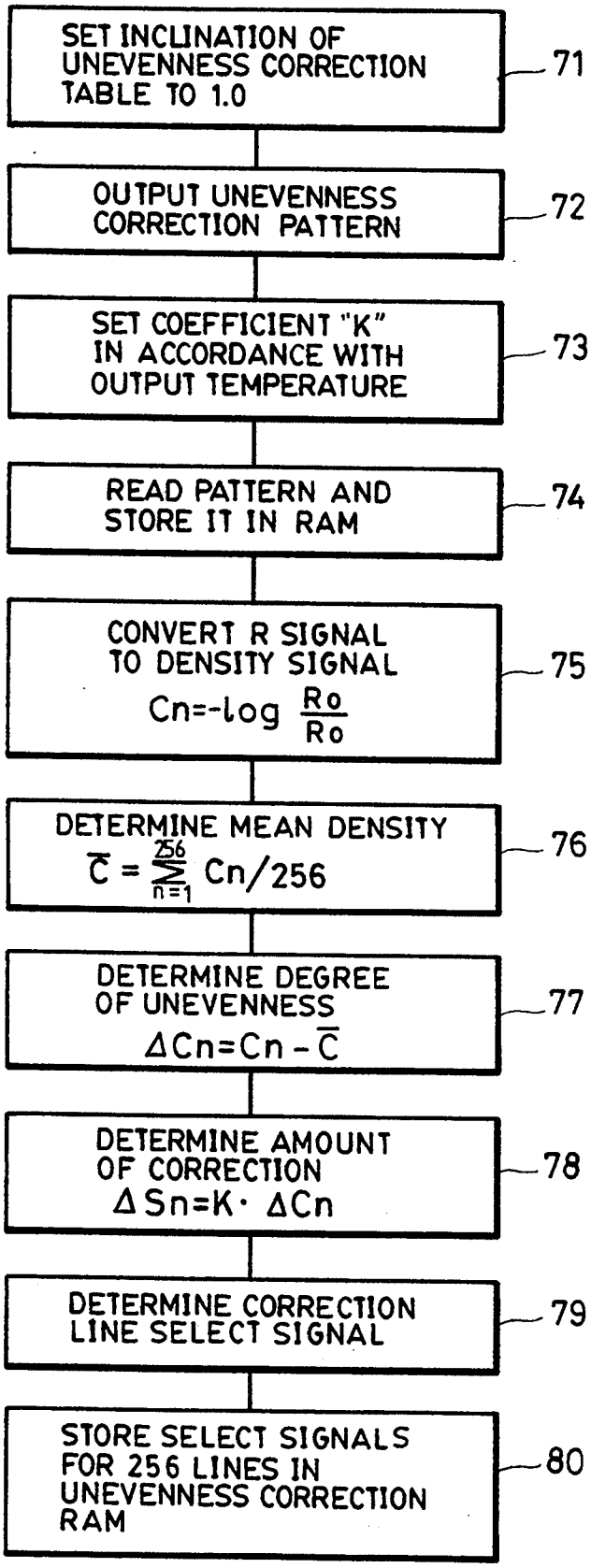
FIG. 3 is a flow chart of the operation of the first embodiment of the present invention.

First, all the correction lines of the unevenness correction tables 22a to 22c are set to a straight line having a slope of 1.0 by a control signal (not shown) so that no correction is effected (step 71 of FIG. 3). Then, an unevenness correction test pattern is output from a signal source (not shown) to the unevenness correction tables and is recorded on a sheet or the like (print-output) by the heads 24a to 24c (step 72). The unevenness correction pattern may be a uniform pattern of an arbitrary printing duty, preferably, 30 to 75% duty. In this embodiment, a uniform 50% duty pattern is recorded in each of cyan, magenta and yellow.

The temperature sensors 103a to 103c attached to the heads 24a to 24c, respectively, detect the head temperatures during printing of this pattern and send the detected temperatures to the CPU 105.

The CPU 105 sets an optimal correction amount calculation coefficient K with respect to each color according to the input head temperature (step 73).

Output patterns are read by the reading section 25, and reading signals 26a to 26c thereby read with respect to the three colors are temporarily stored in the RAM 32 (step 74). The reading density of the CCD of the reading section 25 is equal to the recording density of each head. In this embodiment, it is 400 dpi. The number of pixels is at least equal to the number of nozzles of each head, i.e., 256. Unevenness distributions of the heads are obtained from red (R), green (G) and blue (B) signals obtained by this reading, that is, an unevenness distribution of the cyan head is obtained from the red signal, an unevenness distribution of the magenta head is obtained from the green signal, and an unevenness distribution of the yellow head is obtained from the blue signal. For ease of explanation, only unevenness correction based on obtaining an unevenness distribution of the cyan head will be described below.

Red signal Rn (n=1 to 256) is obtained with respect to the nozzles of the cyan head.

This signal is converted into a cyan density signal by the following equation to obtain a density unevenness distribution:

$$Cn = -\log \frac{Rn}{Ro} \text{ (} Ro \text{ is a constant, } Ro \geqq Rn\text{) (step 75).}$$

Next, a mean density of cyan is calculated by $$\overline{C} = \sum_{n=1}^{256} Cn/256 \text{ (step 76).}$$

Then, the deviation of the densities of the nozzles from the mean density is calculated by $$\Delta Cn = Cn - \overline{C} \text{ (step 77).}$$

Next, the amount of signal correction $(\Delta S)n$ according to $(\Delta C)n$ is obtained by $$\Delta Sn = K\,(\Delta Cn)$$

(where K is a coefficient determined by the temperature of the cyan head) (step 78).

The signal for selecting the correction line to be selected according to $\Delta Sn$ is obtained and correction signals having 61 values, i.e., 0 to 60 with respect to 256 nozzles are stored in the unevenness correction RAM 29a (steps 79, 80).

Figure 9:
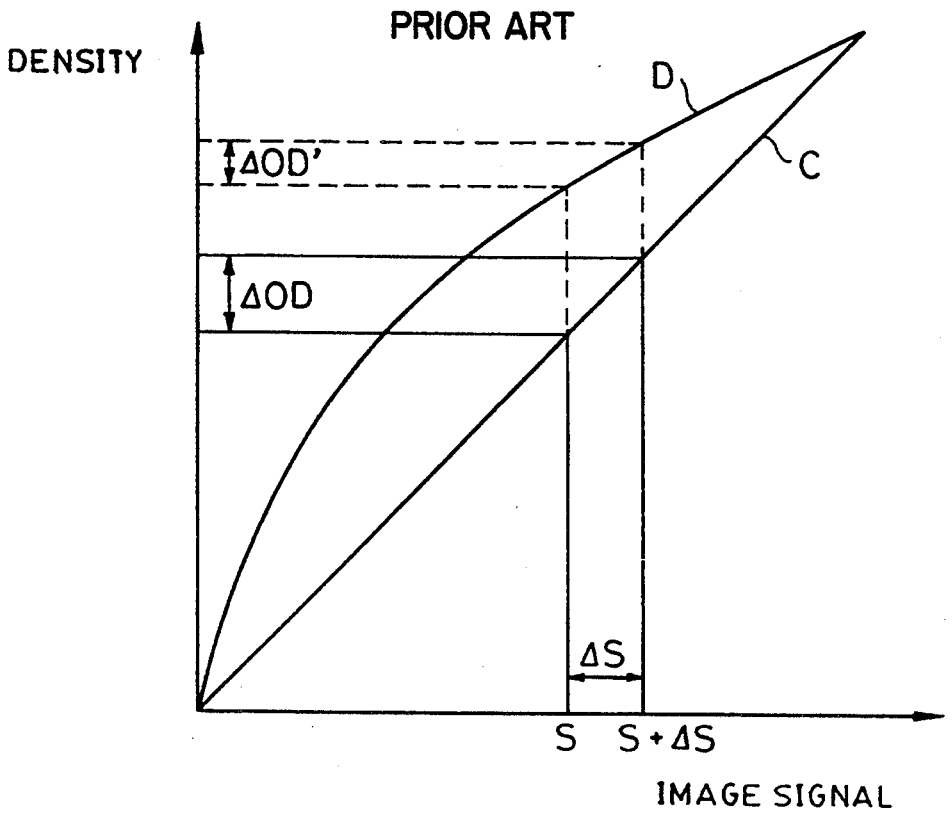
FIG. 9 PRIOR ART
FIG. 9 is a diagram of a situation where a gradation characteristic varies.

Based on the correction data thus prepared, straight lines $\gamma$ are selected with respect to the nozzles to correct density unevenness. The optimal coefficient K for each head may be increased when the temperature of the head is high, since the head will have a gradation characteristic such as that indicated by line D in FIG. 9, and may be reduced when the head temperature is low. The optimal coefficient is thus set according to the head temperature, so that an optical correction value can be obtained in a short time, thereby correcting density unevenness.

The same operation is also performed with respect to magenta and yellow. It is thus possible to effect density unevenness correction in a short time and to minimize the down time of the apparatus.

In the apparatus of the present invention, to read the printed correction pattern, the output sample may be operated in the reading section by the user or serviceman. The arrangement may alternatively be such that the printed sample is automatically read by the apparatus. The reading section may also serve as a reader for reading an original for copying, or a reader having this function may be provided separately.

Figure 4:
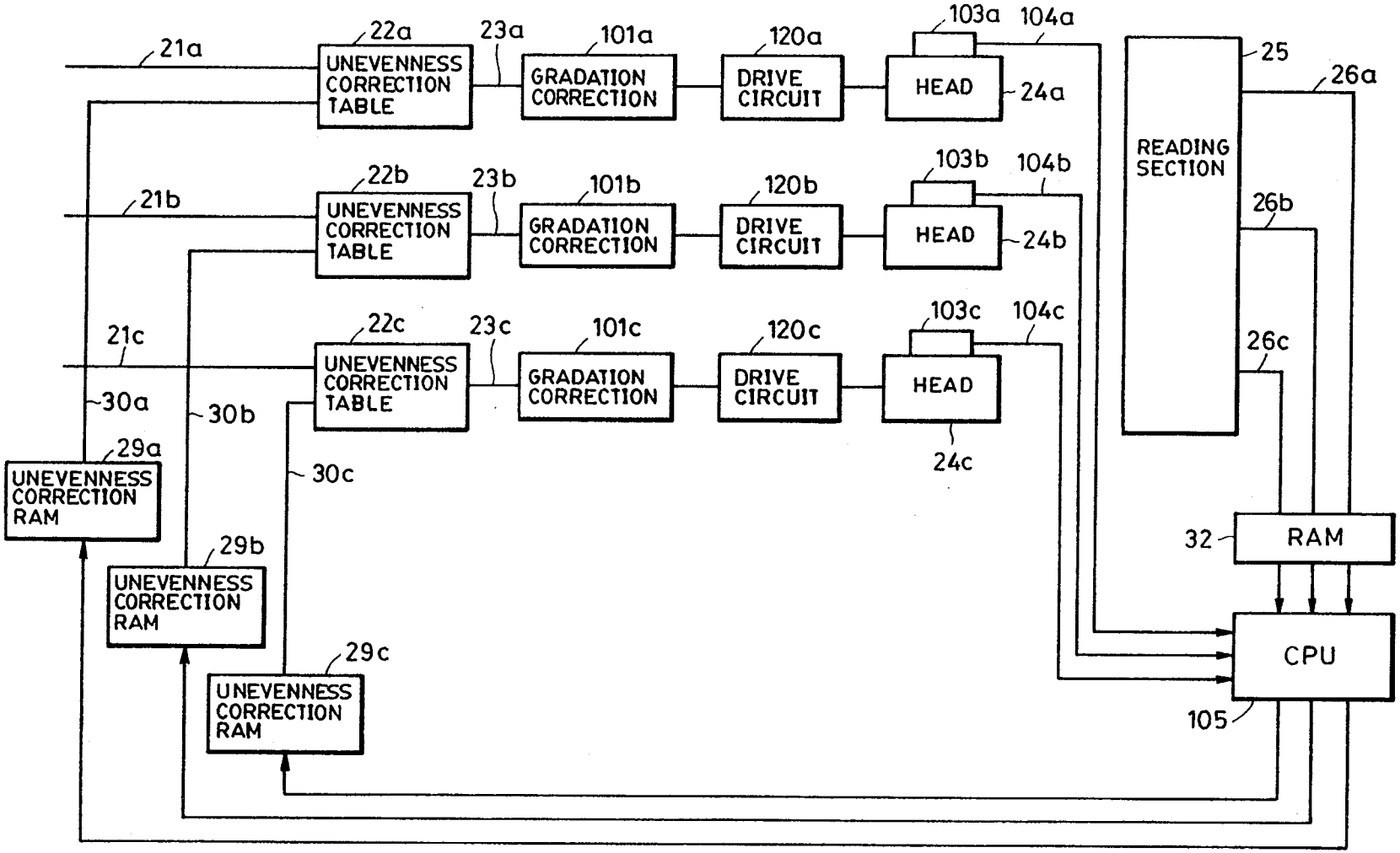
FIG. 4 is a block diagram of an image recording apparatus in accordance with second and third embodiments of the present invention.
Figure 5A:
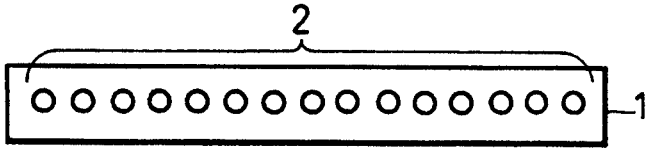
FIG. 5(a) PRIOR ART
FIGS. 5(*a*) to 5(*e*) are diagrams of a conventional method of correcting density unevenness.
Figure 5B:
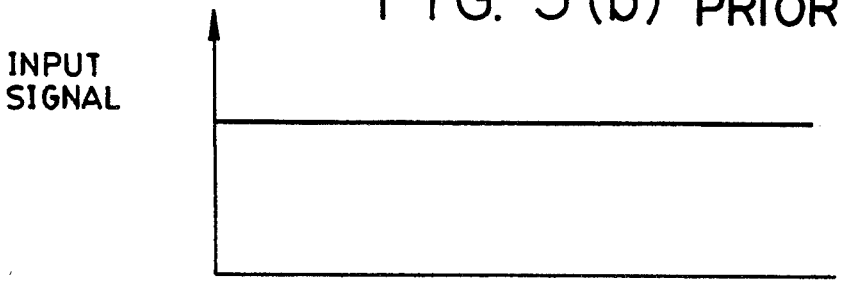
FIG. 5(b) PRIOR ART
Figure 5C:
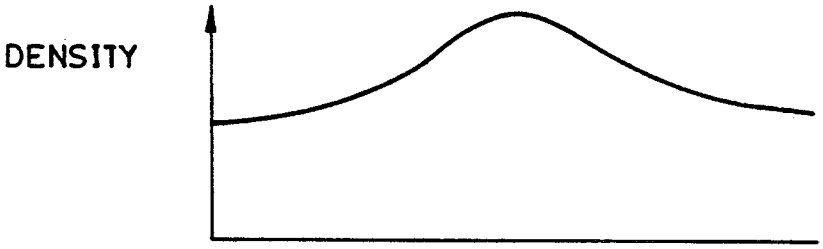
FIG. 5(c) PRIOR ART
Figure 5D:
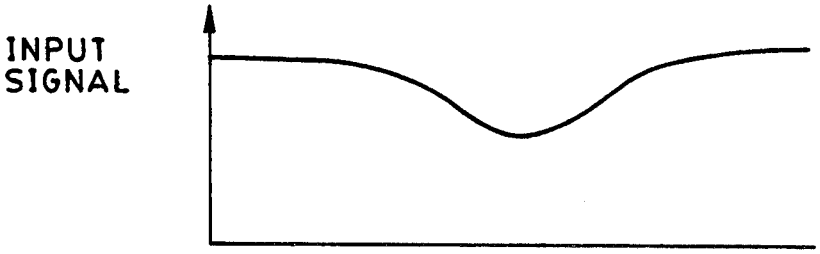
FIG. 5(d) PRIOR ART
Figure 5E:
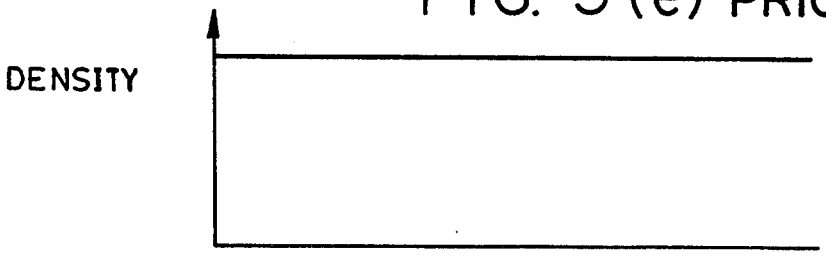
FIG. 5(e) PRIOR ART
Figure 6:
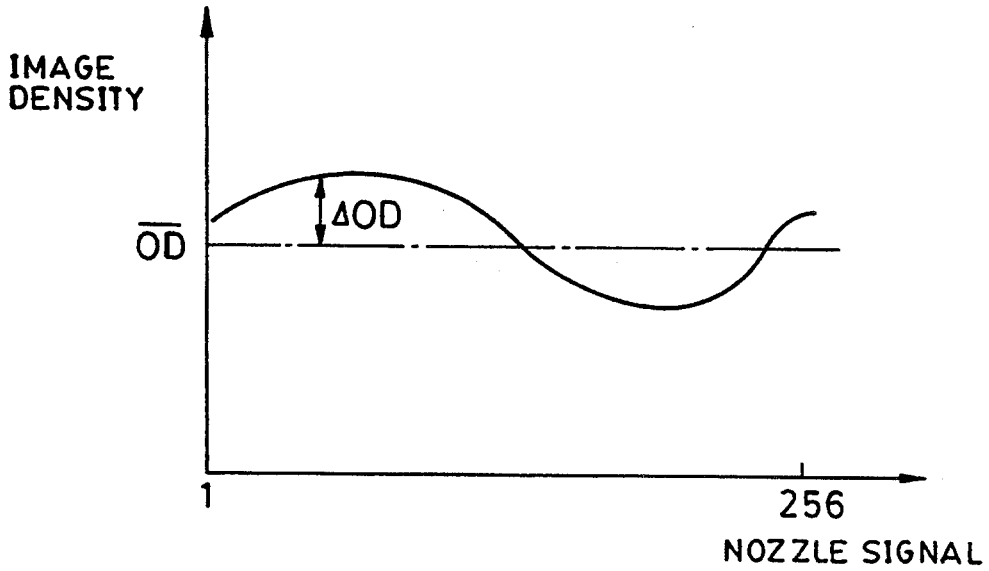
FIG. 6 PRIOR ART
FIG. 6 is a diagram of density unevenness.
Figure 7:
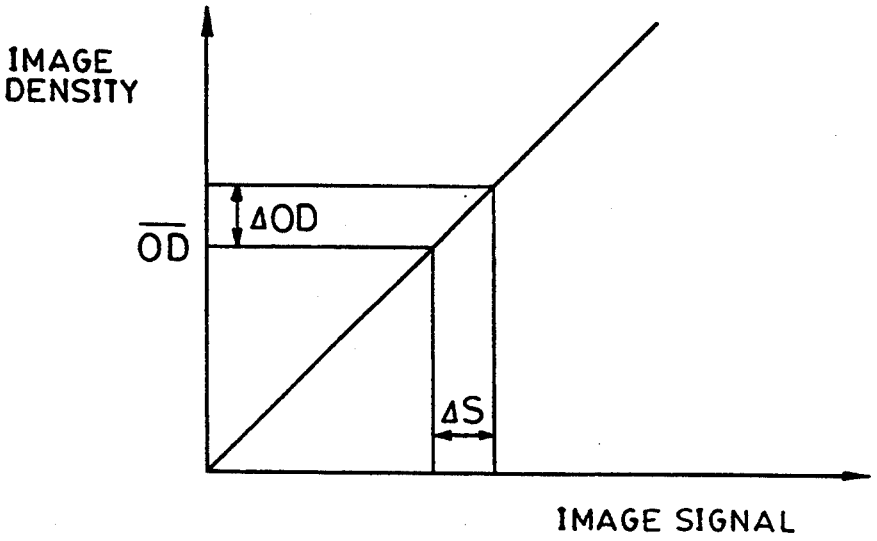
FIG. 7 PRIOR ART
FIG. 7 is a diagram of an ideal gradation characteristic.
Figure 8:
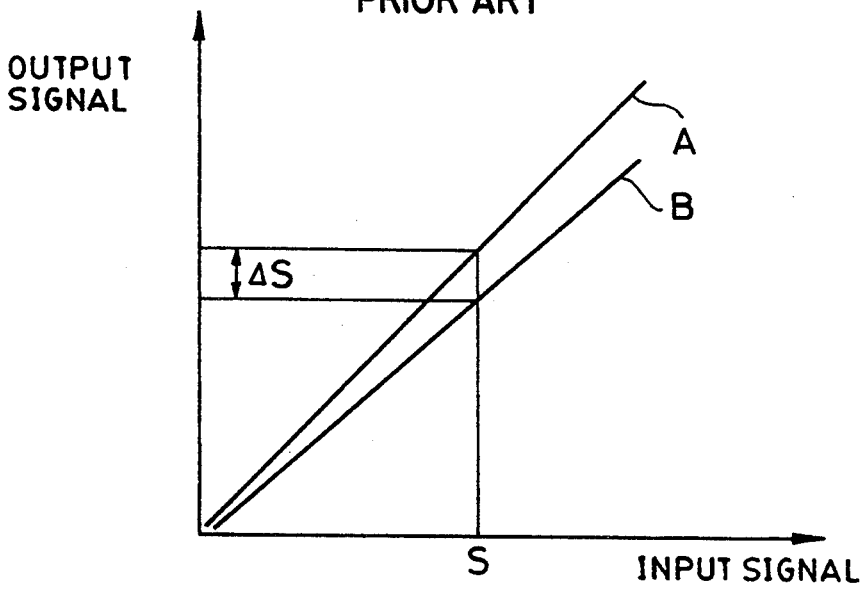
FIG. 8 PRIOR ART
FIG. 8 is a diagram of a density unevenness correction line.

FIG. 4 shows a block diagram of the second embodiment of the present invention. In FIG. 4, components identical or corresponding to those shown in FIG. 1 are indicated by the same reference symbols. The description for such components will not be repeated.

Drive circuits 120a, 120b, and 120c are provided which are supplied with image signals from gradation correction tables 101*a* to 101*c* and which output head driving pulses at voltages corresponding to the values of the image signals. Heads 24*a*, 24*b*, and 24*c* are multi-element heads capable of changing the dot diameter by changing the drive voltage, such as a a piezoelectric type ink jet head. According to this arrangement, the present invention can also be applied to an image recording apparatus in which density unevenness is corrected by changing the dot diameter.

The third embodiment of the present invention will be described below.

The third embodiment has the same blocks as those shown in FIG. 4.

In the third embodiment, the drive circuits are designed so as to output drive pulses with pulse widths proportional to the values of the image signals, and each head is capable of changing the dot diameter according to the pulse width. By this arrangement, the same effect as that of the second embodiment can be obtained.

The heads, which have been described as ink jet heads with respect to the embodiments, may be thermal transfer heads.

It is not always necessary to effect density unevenness correction for each image recording element. Density unevenness correction may be effected with respect to blocks of image recording elements each arrayed continuously.

The embodiments of the present invention have been described as applications of the invention to image recording apparatuses for obtaining color images by using three colors, cyan, magenta and yellow. However, the present invention is also effective when applied to a monochromatic image recording apparatus, e.g., black.

According to the present invention, as described above, correction data is prepared in a short time by being calculated according to the temperature of the head, thereby minimizing the down time of the apparatus.

The individual components shown in outline or designated by blocks in the drawings are all well-known in the image recording arts, and their specific construction and operation is not critical to the operation or best mode for carrying out the invention.

In the first embodiment, an ink jet method for recording based on forming a flying droplet of ink by utilizing thermal energy is used. Preferably, the construction and the principle of this system are generally based on the fundamental principles disclosed in U.S. Pat. Nos. 4,723,129 and 4,740,796. This method can be applied to both the on-demand type and the continuous type recording heads. In the case of the on-demand type, at least one drive signal is applied to each of the electro-thermo-conversion elements arranged in liquid passages containing a liquid (ink) according to recording information drive signals. Thermal energy is thereby generated in the electro-thermo-conversion element so that the temperature of the ink is abruptly increased and film nucleate boiling occurs on a thermal action surface of the recording head, thereby forming bubbles of the liquid (ink) corresponding to the drive signal in a one-to-one relationship. In this arrangement, therefore, the ink jet method is particularly effective. By the growth and shrinkage of bubbles thereby formed, the liquid (ink) is jetted through an outlet orifice to form at least one droplet. If the drive signal has a pulse-like form, the growth and shrinkage of bubbles are effected rapidly and suitably, and the liquid (ink) jetting response is particularly improved. Therefore the use of a pulse-like drive signal is more preferable.

As this pulse-like drive signal, those described in U.S. Pat. Nos. 4,463,359 and 4,345,262 are preferred. If the conditions of the rate at which the temperature of the thermal action surface is increased are set as described in U.S. Pat. No. 4,313,124, the recording performance is further improved.

Recording head constructions other than those disclosed in the specifications of the above-mentioned patents wherein an outlet orifice, a liquid passage and an electro-thermo-conversion element are combined (a straight liquid flow passage or right-angled liquid flow passage) may be adopted. For example, a type of construction, such as that disclosed in U.S. Pat. Nos. 4,558,333, or 4,459,600, in which a thermal action section is arranged in a bent region of the liquid passage may be adopted.

Also, a construction, such as that disclosed in Japanese Patent Laid-Open Application No. 59-123670, in which a slit is used as a con, non outlet facing a plurality of electro-thermo-conversion elements, and another construction, such as that disclosed in Japanese Patent Laid-Open Application No. 59-138461, in which an opening for absorbing pressure waves caused by thermal energy is provided so as to face a jetting section may be adopted.

A full-line recording head having a length equal to a maximum width of recording mediums which can be used for recording in the recording apparatus may be used. This type of recording head may be arranged to have the desired length by combining of a plurality of recording heads constructed in accordance with each of the above-mentioned patent, or may be arranged as one integral recording head.

Further, an interchangeable recording head may be used which can be electrically connected to the body of the recording apparatus and can be supplied with ink therefrom when attached to the apparatus body, and a cartridge type recording head may also be used in which an ink tank is formed integrally with the recording head.

With respect to the above-described embodiments, the ink has been described as a liquid. However, the ink may be of a type softened at room temperature or a type having a liquid form only when the operating recording signal is applied, since, according to the above-described ink jet method, it is a common practice to control the temperature of the ink in a range of 30° to 70° C. so that the viscosity of the ink is in a stable jetting range.

Also, an ink having a property such that it is liquefied only when supplied with thermal energy, e.g., a type liquefied by application of thermal energy in accordance with the recording signal to be jetted, or a type which starts solidifying when it reaches the recording medium, can be used in accordance with the present invention in such a manner that the increase in temperature caused by thermal energy is limited to a preferred range by positively utilizing thermal energy as energy for the change in state from the solid state to the liquid state. Such a property of the ink can be selected also for the purpose of preventing evaporation of the ink because the ink is in solid form when the apparatus is not in use. In such a case, the ink may be supplied so as to face the electro-thermo-conversion elements while being retained in a liquid or solid state in recesses of a porous sheet or in through holes, as described in Japanese Patent Laid-Open Application Nos. 54-56847 or 60-71260. According to the present invention, it is most effective to practice the above-mentioned film boiling method with respect to the inks described above.

The recording apparatus in accordance with the present invention may be integrally or separately provided as image output terminals of information processing apparatuses such as word processors or computers, as a copier combined with a reader or as a facsimile apparatus having transmission-reception functions.

While the present invention has been described with respect to what presently are considered to be the preferred embodiments, it is to be understood that the invention is not limited to the disclosed embodiments. To the contrary, the present invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. An image recording apparatus comprising:

input means for inputting image signals;

recording means having a plurality of image recording elements for recording an image on a recording material by driving said plurality of image recording elements in accordance with the image signals, wherein a predetermined image recorded by said plurality of image recording elements is representative of density unevenness in accordance with a change in a temperature or a variation in a recording characteristic of said plurality of image recording elements;

data generating means for generating data based on predetermined image density unevenness recorded by said recording means;

temperature detection means for detecting the temperature of said recording means and outputting a temperature detection result;

correction data calculation means for outputting common density unevenness correction data for correcting density unevenness in accordance with a temperature detection result output from said temperature detection means and the data based on the density unevenness output from said data generating means; and correction means for making a correction to each of the image signals input from said input means based on the common density unevenness correction data output from said correction data calculation means and outputting corrected image signals to said recording means, wherein said correction means corrects the image signals in such a manner that an image recorded at a uniform density can be produced when the image signals input from said input means to said plurality of image recording elements are at a uniform level.

2. An image recording apparatus according to claim 1, wherein said correction means stores a plurality of image signal correction data items for correcting the image signals to be input to said image recording elements, selects one of the image signal correction data items based on the density unevenness correction data, and corrects the image signals to be input in accordance with the selected image signal correction data item.

3. An image recording apparatus according to claim 1 or 2, wherein said correction data calculation means obtains a mean density from the recording densities of the predetermined image formed by said plurality of image recording elements, and calculates the density unevenness correction data as a function of the recording density of each image recording element and the mean density.

4. An image forming apparatus according to claim 3, wherein said correction data calculation means calculates the density unevenness correction data for each image recording element by calculating the deviation of the recording density of each image recording element from the mean density.

5. An image forming apparatus according to claim 4, wherein said correction data calculating means obtains the density unevenness correction data by multiplying the calculated deviation of the recording density of each image recording element by a predetermined coefficient.

6. An image forming apparatus according to claim 5, wherein said correction data calculation means varies the predetermined coefficient in accordance with the temperature detection result output from said temperature detection means.

7. An image forming apparatus according to claim 1, wherein said recording means includes a plurality of recording heads, each having a plurality of said image recording elements, and each of said plurality of recording heads records in a different recording color.

8. An image forming apparatus according to claim 6, wherein said recording means includes a plurality of recording heads, each having a plurality of said image recording elements, and each predetermined coefficient is based on the temperature of the respective recording head.

9. An image forming apparatus according to claims 1 or 2, wherein each image recording element causes a change in the state of ink in said recording means by energy generated by electric power supplied to the image recording element to eject the ink.

10. An image forming apparatus according to claim 3, wherein each image recording element causes a change in the state of ink in said recording means by energy generated by electric power supplied to the image recording element to eject the ink.

11. An image forming apparatus according to claim 4, wherein each image recording element causes a change in the state of ink in said recording means by energy generated by electric power supplied to the image recording element to eject the ink.

12. An image forming apparatus according to claim 5, wherein each image recording element causes a change in the state of ink in said recording means by energy generated by electric power supplied to the image recording element to eject the ink.

13. An image forming apparatus according to claim 6, wherein each image recording element causes a change in the state of ink in said recording means by energy generated by electric power supplied to the image recording element to eject the ink.

14. An image forming apparatus according to claim 7, wherein each image recording element causes a change in the state of ink in said recording means by energy generated by electric power supplied to the image recording element to eject the ink.

15. An image forming apparatus according to claim 8, wherein each image recording element causes a change in the state of ink in said recording means by energy generated by electric power supplied to the image recording element to eject the ink.

16. An image forming apparatus according to claim 9, wherein the energy is thermal energy.

17. An image forming apparatus according to claim 10, wherein the energy is thermal energy.

18. An image forming apparatus according to claim 11, wherein the energy is thermal energy.

19. An image forming apparatus according to claim 12, wherein the energy is thermal energy.

20. An image forming apparatus according to claim 13, wherein the energy is thermal energy.

21. An image forming apparatus according to claim 14, wherein the energy is thermal energy.

22. An image forming apparatus according to claim 15, wherein the energy is thermal energy.

* * * * *

UNITED STATES PATENT AND TRADEMARK OFFICE

CERTIFICATE OF CORRECTION

PATENT NO. : 5,343,231

DATED : August 30, 1994

INVENTOR(S) : Akio SUZUKI

It is certified that error appears in the above-indentified patent and that said Letters Patent is hereby corrected as shown below:

COLUMN 1:

Line 9, "Of" should read --of--.

COLUMN 2:

Line 29, "input" should read --input S.--.

COLUMN 8:

Line 21, "con, non" should read --common--.

Signed and Sealed this

Fourteenth Day of February, 1995

*Attest:*

*Attesting Officer*

BRUCE LEHMAN

*Commissioner of Patents and Trademarks*